US010914083B2

(12) United States Patent
Johnson et al.

(10) Patent No.: US 10,914,083 B2
(45) Date of Patent: Feb. 9, 2021

(54) WALL-CLIMBING CONCRETE FORM LIFTING SYSTEM

(71) Applicant: Wilian Holding Company, Des Moines, IA (US)

(72) Inventors: James Johnson, Clive, IA (US); Thomas Waldschmitt, Ankeny, IA (US); Andrew Gray, Ankeny, IA (US); Robert McCracken, Urbandale, IA (US)

(73) Assignee: Wilian Holding Co., Des Moines, IA (US)

( * ) Notice: Subject to any disclaimer, the term of this patent is extended or adjusted under 35 U.S.C. 154(b) by 0 days.

(21) Appl. No.: 16/437,879

(22) Filed: Jun. 11, 2019

(65) Prior Publication Data

US 2019/0376301 A1 Dec. 12, 2019

Related U.S. Application Data

(60) Provisional application No. 62/683,187, filed on Jun. 11, 2018, provisional application No. 62/683,776, filed on Jun. 12, 2018.

(51) Int. Cl.

| | |
|---|---|
| ***E04G 11/28*** | (2006.01) |
| ***E04G 11/02*** | (2006.01) |
| ***E04G 21/04*** | (2006.01) |

(52) U.S. Cl.
CPC ..... *E04G 11/28* (2013.01)

(58) Field of Classification Search
CPC ..... E04G 11/28; E04G 11/02; E04G 21/0427; E04G 21/0445

(Continued)

(56) References Cited

U.S. PATENT DOCUMENTS 2,118,374 A 2/1936 Doyle
2,516,318 A 7/1950 Hawes
(Continued)

FOREIGN PATENT DOCUMENTS

BE 878587 A1 * 12/1979 ..... E04G 11/22
WO 2013110126 A1 8/2013
WO WO-2013110126 A1 * 8/2013 ..... E04G 11/28

OTHER PUBLICATIONS

Press Release, "PERI Launches New Self-Climbing Formwork System ACS_Core 400 in the US", 2016.

*Primary Examiner* — Michael Safavi
(74) *Attorney, Agent, or Firm* — Davis, Brown, Koehn, Shors & Roberts, P.C.; Sean D. Solberg

(57) ABSTRACT

A self-climbing concrete wall form hoist for forming a concrete wall section atop a previously formed wall section has a wall mounting releasably secured to the previously formed wall section, a plurality of moveable vertical masts, an extendable cylinder inside each mast, and a platform alternatively supported on the masts, which in turn are supported alternatively on the upper and lower wall mountings. The apparatus cycles between a platform raising position when the masts and platform are supported on the upper wall mounting and a lower wall mounting raising position when the masts and platform are supported on the upper wall mounting. The extendable cylinders are extended to raise the mast and platform relative to the lower wall mounting when the masts are supported on the upper wall mounting, and the extendable cylinders are retracted when raising the lower wall mounting relative to the platform when the masts and platform are supported on the upper wall mounting. The self-climbing concrete wall form hoist can descend a wall by effectively reversing the steps required to complete wall climbing.

16 Claims, 10 Drawing Sheets

(58) Field of Classification Search
USPC ..... 264/33; 425/63, 64, 65; 249/20
See application file for complete search history.

(56) References Cited

U.S. PATENT DOCUMENTS

| | | | | |
|---|---|---|---|---|
| 3,628,223 | A | 12/1971 | Babee | |
| 4,043,087 | A | 8/1977 | Connors | |
| 4,108,583 | A * | 8/1978 | Ellen | E04G 11/22 249/22 |
| 4,290,576 | A | 9/1981 | Schworer | |
| 4,530,648 | A | 7/1985 | Phillips | |
| 5,000,287 | A | 3/1991 | Schworer | |
| 5,263,835 | A | 11/1993 | Schmidt | |
| 5,630,482 | A | 5/1997 | Schworer | |
| 6,260,311 | B1 * | 7/2001 | Vladikovic | E04G 11/28 249/20 |
| 6,276,912 | B1 * | 8/2001 | Rock | E04G 11/28 249/20 |
| 6,557,817 | B2 | 5/2003 | Waldschmitt et al. | |
| 8,020,271 | B2 | 9/2011 | Baum et al. | |
| 9,611,663 | B2 | 4/2017 | Baum | |
| 2003/0052249 | A1 | 3/2003 | Waldschmitt et al. | |
| 2007/0125442 | A1 | 6/2007 | Tribble | |

* cited by examiner

WALL-CLIMBING CONCRETE FORM LIFTING SYSTEM

CROSS-REFERENCE TO RELATED APPLICATION(S)

This application claims the benefit under 35 U.S.C. § 119(e) to U.S. Provisional Application 62/683,187, filed Jun. 11, 2018 and entitled "Concrete Forming System," and U.S. Provisional Application 62/683,776, filed Jun. 12, 2018 and entitled "Concrete Forming System," both of which are hereby incorporated herein by reference in their entireties.

FIELD OF THE INVENTION

The various embodiments herein relate to systems and devices (including hoists) used in building concrete walls, including concrete walls of buildings and similar structures, and in particular to a wall climbing form system for handling form units in the construction of concrete wall structures for multi-story buildings.

BACKGROUND OF THE INVENTION

In the construction of a multi-story building, such as an office building, apartment building or the like, the building may have thirty or more floors. Where concrete is used in the construction of the outside or inside walls, it is necessary in known processes to provide cranes in the setting up and then stripping of the forms from a set wall panel for reuse in continuing the completion of the wall. In such known approaches, unless a crane is available as required in the setting up and stripping of the forms, the wall not only becomes costly, but additional cost increases are incurred by lost time on other operations that must be performed in a synchronized time schedule with the wall forming operation. In addition, the required use of the crane for setting up and stripping the form panels for concrete construction (also referred to herein as "concrete forms" or "concrete form panels" or "form panels") means that the crane is unavailable for use on other jobs at the building site, thereby resulting in further loss of time and increased costs. Where open crane time for timely handling of the form units is not available, construction usually proceeds behind schedule with resultant monetary losses. In addition, the size and/or configuration of the construction site can also make it impossible to use a crane for handling the concrete forms. For example, in some instances, the size of the building being constructed relative to the building site may preclude the use of a crane due to space constraints adjacent to the building.

A known system for constructing concrete walls about two stories high is shown in U.S. Pat. No. 2,516,318; and for multi-story buildings, in U.S. Pat. Nos. 4,043,087; and 2,118,374. Self-lifting form systems now in use are generally cumbersome and, although inconvenient to manipulate during both a wall climbing operation and a form handling operation, have been found to be generally satisfactory in comparison to other available technologies. U.S. Pat. No. 3,628,223 discloses a climbing form hoist that includes a telescopic mast comprised of a pair of vertical lower mast sections for telescopically receiving associated upper mast sections which are extended and retracted by a common reversible electric motor. The upper mast sections carry an outer form unit. With the mast retracted and attached at its lower end to a completed lower wall section, the inner and outer form units are braced or tied together in any well-known manner after which a new lift or wall section is poured. When the new pour has set, the outer form unit, after being stripped from the wall structure, is elevated by the extension of the upper mast sections to a new pour position wherein its lower end is attachable to the previously poured wall section. The lower mast sections are then released from the wall, the upper mast section is retracted and the lower mast section again connected to the wall. The inner form unit is then repositioned for another lift to be poured.

U.S. Pat. No. 4,290,576 discloses a climbing scaffolding which utilizes a guiding rail only as a vertical guide, but not to support the load resulting from the weight of the scaffolding in the vertical direction. The '576 patent requires its operators to manually fix the scaffolding in its lifted position by inserting pins into cutouts or by placing wedges underneath to support the load. U.S. Pat. No. 5,000,287 discloses a displaceable platform which is movable section-wise on a wall, comprising support shoes, carrying rails, and a bracketing arrangement to support the platform. The thrust of the '287 patent is the correction of non-uniform upward travel of its displacement elements through very small advancements on a toothed displacement rack and a common drive and controller apparatus that prohibits further upward displacement until all linear drives have completed the preceding working step or one of the proceeding working steps. While the ratcheting mechanism of the '287 patent's tooth displacement rack may provide for fewer incidents of jamming (therefore minimizing related down time due to mechanical failures), the need to correct for non-uniform upward travel across different elements can require additional time and system mechanisms that add time and expense.

U.S. Pat. No. 5,630,482 discloses a self-climbing device which utilizes two types of scaffolding shoes: one for guiding and one for guiding and exhibiting attachment devices; two types climbing heads: a lower head with a pivotable member supported by a sidewall enclosure, and an upper head with a pivotable member supported by two additional housing walls provided between the outer housing walls of the sidewall enclosure; and two types of protuberances extending from a guide rail which provide, in a plurality of steps, a locking and loosening means by which a platform may be lifted or lowered along the length of a mounting rail. One disadvantage of the self-climbing device of the '482 patent is the complexity of the device and the number of different components that must function together for successful operation of the device.

U.S. Pat. No. 8,020,271 discloses a self-raising form control system that may be used to form elevator shafts and other vertical building structures. A lift apparatus having a plurality of hydraulic cylinders is provided for lifting form elements. The lift apparatus comprises a measurement device for measuring the position of said lift apparatus relative to a fixed point. A control unit is provided for controlling the lift apparatus. The control unit is signal connected to the measurement device and is signal connected to the lift apparatus and stops one or more of the hydraulic cylinders during a lift to maintain alignment of the self-raising form during a raise.

U.S. Pat. No. 6,557,817 disclose a self-climbing device having a platform that is alternatingly supported on a climbing mast and on a wall mount. In order for the system to climb to the next level, the formwork panels are stripped away from the surface an appreciable distance to provide clearance so that a climbing mast can be raised and releasably secured to the upper area of the freshly poured concrete wall. At that point, sufficient time must then be allowed for the freshly-poured concrete to mature to an adequate strength before any load can be applied. Thus, one disadvantage is the delay necessary to wait for the concrete to mature before additional work can be performed.

There is a need in the art for an improved wall-climbing system and device for handling form units in the construction of concrete wall structures for multi-story buildings.

BRIEF SUMMARY OF THE INVENTION

Discussed herein are various wall-climbing concrete form lifting systems and devices.

The various wall climbing form hoist embodiments herein provide for an appreciable reduction both in the amount of labor and crane time required in the construction of multi-story outside or inside concrete walls (including, for example, interior core shafts like stairwells and elevator shafts). The embodiments are efficient in operation to handle both the inside and the outside form units for the pouring and setting of successive lifts or horizontal wall sections and are readily adapted for handling form gangs. Various implementations are hydraulically operated and remotely controlled and include a platform or scaffold upon which workmen can be safely carried. Further, in these embodiments, a base or supporting frame carries the platform and the outer form unit. In addition, a plurality of extendable cylinders for raising the hoist are each surrounded by a tower mast.

In use, according to one embodiment, with the first two stories of the concrete wall structure previously constructed in any suitable manner, a plurality of support brackets are secured to the poured wall sections and the hoist is lifted in position by a crane or suitable alternative means to provide for the securement of the form hoist to the wall and the setting of the outer form unit and an inner form unit for a new pour. When the new pour has been completed and has set, the support frame is supported on jack support brackets and the extendable cylinders are used to move the hoist upwardly a story height. According to certain embodiments, the extendable cylinders move continuously during a raise and are controlled to accelerate or decelerate the movement of each extendable cylinder, as needed, to maintain alignment of the hoist throughout the raise. Once the support frame is raised to the next pour position, the upper support brackets are releasably secured to the freshly poured concrete wall and work can immediately commence to prepare for the next pour. Concurrently, once the freshly poured concrete has achieved the required strength, the jack brackets are released from the previously poured wall. The jack support brackets are then moved upwardly relative to the hoist by retracting the extendable cylinders and are subsequently secured to the freshly poured concrete. Once the formwork is ready, a new pour is then made and the cycle of operations repeated until a desired height of the wall structure is attained. In another embodiment of the invention, a crane is utilized to lower the climbing form hoist to the ground.

In Example 1, a self-climbing concrete wall form hoist for forming a concrete wall section atop a previously formed wall section comprises upper and lower wall mountings releasably secureable to the previously formed wall section, at least one moveable vertical mast, an extendable cylinder moveably coupled with the at least one mast, and a platform alternatively supported on the upper and lower wall mountings. The cylinder comprises a retracted position wherein the cylinder is disposed within the at least one mast and an extended position wherein the cylinder is extended from the at least one mast. The form hoist is cycleable between a platform raising position wherein the extendable cylinder is supported on the lower wall mounting, wherein the extendable cylinder is extendable into the extended position, whereby the platform is raised in relation to the concrete wall section, and a mast lower wall mounting raising position wherein the platform is supported on the upper wall mounting, wherein the extendable cylinder is retractable into the retracted position, whereby the lower wall mounting is raised in relation to the platform. Example 2 relates to the self-climbing concrete wall form hoist according to Example 1, further comprising a power unit coupled to the at least one moveable vertical mast, wherein the power unit is operably coupled to the extendable cylinder, wherein the power unit urges the extendable cylinder between the retracted and extended positions.

Example 3 relates to the self-climbing concrete wall form hoist according to Example 1, further comprising a control system operably coupled to the power unit, wherein the control system is configured to control operation of the power unit.

Example 4 relates to the self-climbing concrete wall form hoist according to Example 1, wherein the at least one moveable vertical mast comprises at least two moveable vertical masts, and the extendable cylinder moveably coupled with the at least one moveable vertical mast comprises at least two extendable cylinders, wherein a first of the at least two extendable cylinders is coupled to a first of the at least two vertical masts and a second of the at least two extendable cylinders is coupled to a second of the at least two vertical masts.

Example 5 relates to the self-climbing concrete wall form hoist according to Example 4, further comprising a first power unit coupled to a first of the at least two moveable vertical masts, wherein the first power unit is operably coupled to the first of the at least two extendable cylinders, wherein the first power unit urges the first extendable cylinder between the retracted and extended positions, and a second power unit coupled to a second of the at least two moveable vertical masts, wherein the second power unit is operably coupled to the second of the at least two extendable cylinders, wherein the second power unit urges the second extendable cylinder between the retracted and extended positions.

Example 6 relates to the self-climbing concrete wall form hoist according to Example 5, further comprising a control system operably coupled to at least the first and second power units, wherein the control system is configured to control operation of at least the first and second power units such that the control system causes at least the first and second power units to accelerate or decelerate to maintain a level alignment of the hoist platform throughout movement between the extended and retracted positions of the at least two extendable cylinders.

Example 7 relates to the self-climbing concrete wall form hoist according to Example 6, wherein each of the at least two extendable cylinders comprises a position sensor, wherein the control system is operably coupled to the position sensor such that the control system is configured to determine the necessary power for cylinder extension or retraction, wherein the control system is configured to control the at least two power units based on the necessary power.

Example 8 relates to the self-climbing concrete wall form hoist according to Example 6, wherein the control system is configured to synchronize operation of at least the first and second power units.

Example 9 relates to the self-climbing concrete wall form hoist according to Example 3, further comprising a controller unit in communication with the control system.

In Example 10, a self-climbing concrete wall form hoist comprises at least two extendable masts. Each of the at least two masts comprises a mast body comprising an interior cavity, an extendable cylinder moveably coupled to the mast body, a retracted position wherein the extendable cylinder is disposed within the interior cavity, and an extended position wherein the extendable cylinder is extended a predetermined length out of the mast body. The hoist also comprises a lower removable attachment mechanism releasably attachable to a previously formed concrete wall section, wherein the lower removable attachment mechanism is fixedly coupled to the extendable cylinder, an upper removable attachment mechanism releasably attachable to the previously formed concrete wall section, wherein the upper removable attachment mechanism is fixedly coupled to the mast body, a platform moveably attached to the at least one extendable mast, wherein the platform is disposed above the lower and upper removable attachment mechanisms, a platform raising position, wherein the lower removable attachment mechanism is attached to the previously formed concrete wall section, wherein the at least one extendable mast is extendable into the extended position such that the platform is raised in relation to the concrete wall section, a lower removable attachment mechanism mast raising position, wherein the upper removable attachment mechanism is attached to the previously formed concrete wall section, wherein the extendable cylinder is retractable into the retracted position such that the lower removable attachment mechanism is raised in relation to the platform, and a controller operably coupled to the at least two extendable masts, wherein the controller is configured to synchronize and control operation of the at least two extendable masts such that the controller causes the extendable cylinder of each of the at least two extendable masts to accelerate or decelerate to maintain a level alignment of the platform throughout movement between the extended and retracted positions.

Example 11 relates to the self-climbing concrete wall form hoist according to Example 10, wherein the extendable cylinder comprises a position sensor, wherein the position sensor is operably coupled to the controller.

Example 12 relates to the self-climbing concrete wall form hoist according to Example 10, wherein the extendable cylinder is a hydraulic cylinder.

Example 13 relates to the self-climbing concrete wall form hoist according to Example 12, wherein each of the at least two extendable masts comprises a hydraulic power unit operably coupled to the hydraulic cylinder, wherein the hydraulic power unit urges the hydraulic cylinder between the retracted and extended positions Example 14 relates to the self-climbing concrete wall form hoist according to Example 13, further comprising a central power hub operably coupled to the hydraulic power unit of each of the at least two extendable masts.

Example 15 relates to the self-climbing concrete wall form hoist according to Example 10, wherein the controller causes the extendable cylinder of each of the at least two extendable masts to accelerate or decelerate without stopping to maintain the level alignment of the platform throughout movement between the extended and retracted positions.

In Example 16, a method of building a multi-story concrete structure comprises positioning a hoist system on a previously formed first concrete wall section. The hoist system comprises a first extendable mast comprising a first mast body and a first extendable cylinder moveably coupled to the first mast body, a second extendable mast comprising a second mast body and a second extendable cylinder moveably coupled to the second mast body, a platform moveably attached to the first and second extendable masts, a first lower removable attachment mechanism fixedly coupled to the first extendable cylinder, a second lower removable attachment mechanism fixedly coupled to the second extendable cylinder, a first upper removable attachment mechanism fixedly coupled to the first mast body, and a second upper removable attachment mechanism fixedly coupled to the second mast body. The method also comprises attaching the first and second upper removable attachment mechanisms to the first concrete wall section, forming a desired profile with formwork and pouring concrete into the formwork to add a second concrete wall section, attaching the first and second lower removable attachment mechanisms to the first concrete wall section, detaching the first and second upper removable attachment mechanisms from the first concrete wall section, extending the first and second extendable cylinders such that the first and second extendable masts and the first and second upper removable attachment mechanisms are extended upward a predetermined distance, attaching the first and second upper removable attachment mechanisms to the second concrete wall section, forming the desired profile with the formwork and pouring concrete into the formwork to add a third concrete wall section, detaching the first and second lower removable attachment mechanisms from the first concrete wall section, retracting the first and second extendable cylinders such that the first and second lower removable attachment mechanisms are raised upward until the first and second extendable cylinders are fully retracted, and attaching the first and second lower removable attachment mechanisms to the second concrete wall section.

Example 17 relates to the method according to Example 16, wherein the extending the first and second extendable cylinders comprises accelerating or decelerating the first and second extendable cylinders without stopping the first and second extendable cylinders, and the retracting the first and second extendable cylinders comprises accelerating or decelerating the first and second extendable cylinders without stopping the first and second extendable cylinders.

Example 18 relates to the method according to Example 16, further comprising maintaining a level alignment of the platform.

Example 19 relates to the method according to Example 18, wherein the maintaining the level alignment of the platform comprises actuating the first and second extendable cylinders with a controller to accelerate or decelerate to maintain the level alignment.

Example 20 relates to the method according to Example 18, wherein the maintaining the level alignment of the platform comprises monitoring with position sensors the extension length of the first and second extendable cylinders.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The various implementations set forth herein relate to wall-climbing concrete form hoisting systems and devices for use in building concrete walls for various types of building structures, including, for example, multi-story buildings and similar structures.

Figure 1A:
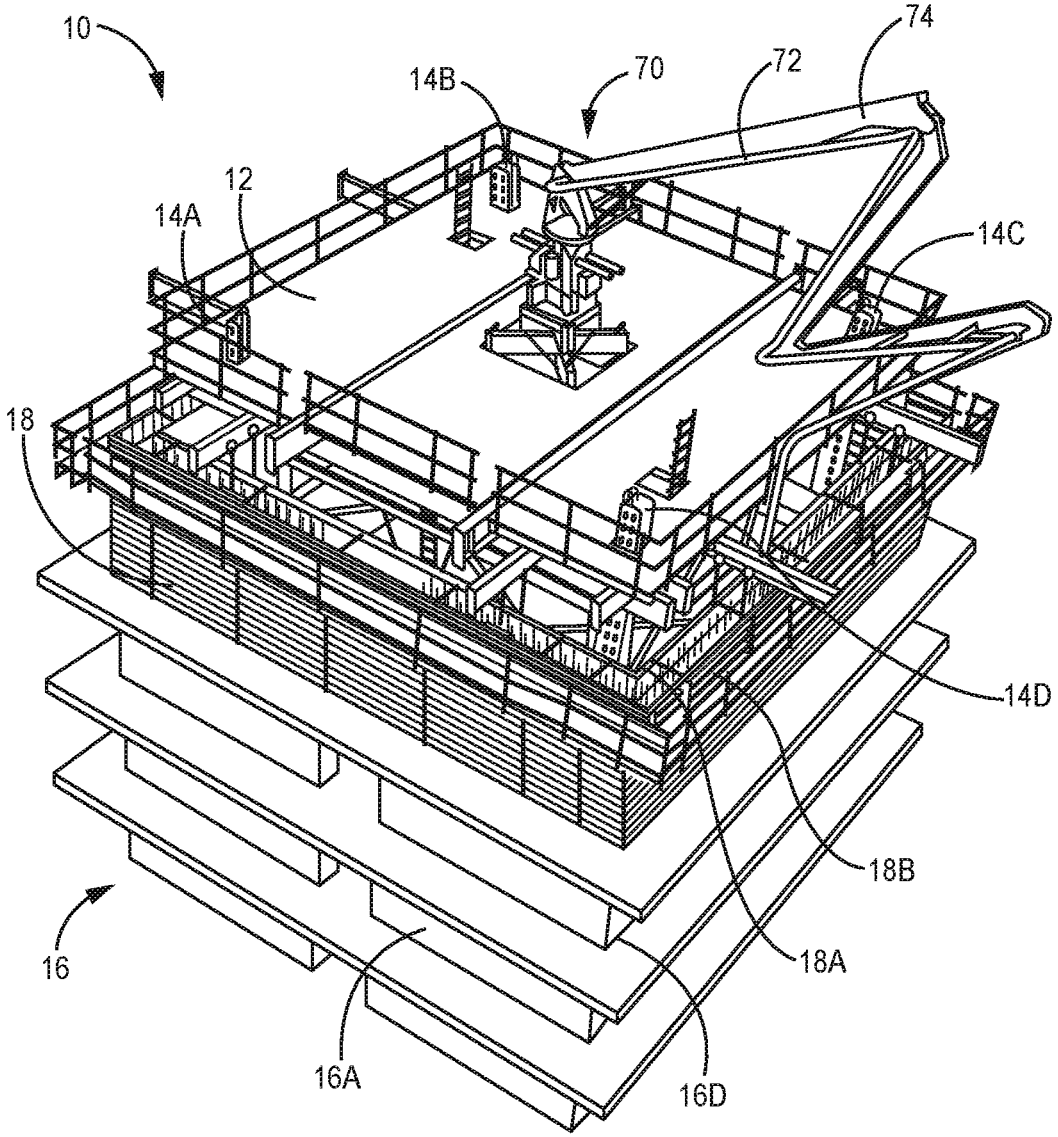
FIG. 1A depicts an upper perspective of a wall climbing form hoist system disposed on a concrete structure that is being formed by the system, according to one embodiment.
Figure 1B:
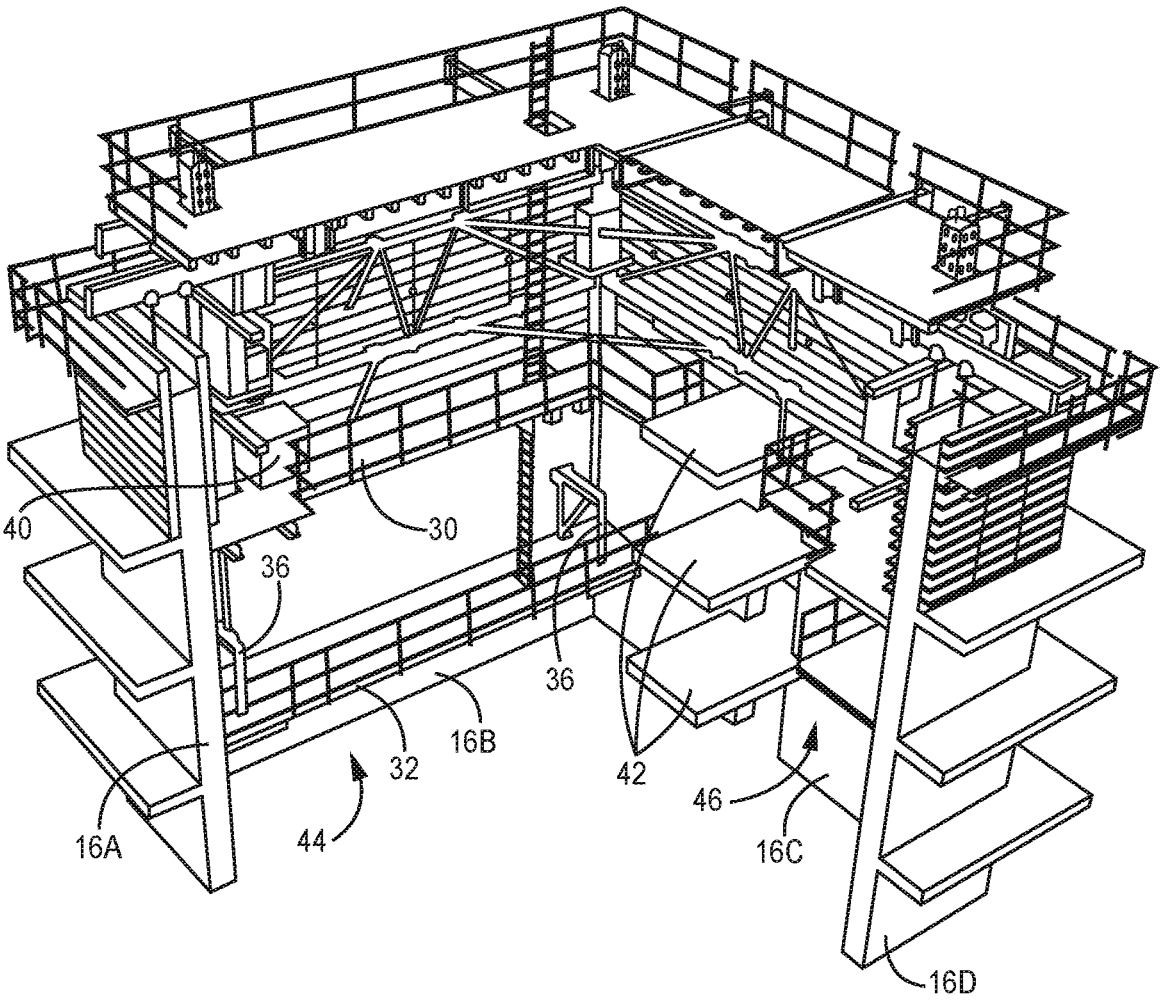
FIG. 1B depicts a cutaway upper perspective of the wall climbing form hoist system of FIG. 1A, according to one embodiment.

FIGS. 1A-1H depict one embodiment of a wall-climbing concrete form hoisting system (also referred to herein as a "hoist") 10 disposed on a building structure 16 (which is made up of walls 16A, 16B, 16C, 16D, as best shown in FIG. 1B). The hoist 10 has a platform (also referred to as a "support frame," "first deck," or "top deck") 12 which is supported for vertical movement on four masts 14 as shown. That is, the support frame 12 is coupled to the four masts 14 on an upper portion of the masts 14 such that the frame 12 is capable of being secured to each mast at different elevations to accommodate a plurality of wall heights. In this specific embodiment, the frame 12 is secured to the four masts 14 such that a small portion of each mast 14 extends above the frame 12 as shown. The support frame 12 adjustably carries a plurality of vertical form panels 18 that hang from the frame 12 (as best shown in FIG. 1D-1H) such that the panels 18 are disposed adjacent to the desired location for the next section of the wall to be poured on the concrete structure 16 being constructed. More specifically, there are inner form panels 18A and outer form panels 18B that are disposed in opposing positions to define the space into which the new concrete will be poured to form the new section of the wall.

As best shown in FIGS. 1B-1H, the hoist 10 also has two additional platforms (or "decks") 30, 32 disposed below the top deck 12. More specifically, as best shown in FIGS. 1C-1F, the hoist 10 has a working deck (also referred to as a "second deck" or "form access deck") 30 that is fixedly attached to the bottom of two masts 14 and removably attachable to the concrete structure 18 via two support brackets (also referred to herein as "support wall mounting components," "support components," and "detachable wall support structures") 34 disposed beneath the deck 30. Further, as also best shown in FIGS. 1C-1F, the hoist 10 also has a lower deck (also referred to herein as a "third deck" or "jack bracket deck") 32 that is fixedly attached to the bottom of two lift (or "extendable") cylinders 50 (discussed in further detail below) and removably attachable to the concrete structure 18 via two jack brackets (also referred to herein as "jack wall mounting components," "jack support components," and "detachable wall jack support structures") 36 that are disposed above and fixedly attached to the deck 32. The specific embodiment as depicted in FIGS. 1A-1H is a hoist 10 having two sections 44, 46, with each of the sections having two masts 14 (for a total of four masts 14). As such, each section 44, 46 has two support brackets 34, two lift cylinders 50, and two jack brackets 36. However, as discussed elsewhere herein, it is understood that various hoist 10 embodiments 10 of a wide variety of different sizes are contemplated herein that can be used to construct structures of a wide variety of sizes. As such, the number of masts 14 (and thus the number of support brackets, lift cylinders, and jack brackets, etc.) can vary from one to any number of masts 14 as necessary to support the size of the specific hoist implementation or section thereof.

The second deck 30 is referred to as the working deck 30 because much of the work performed during use of the hoist 10 to position and cycle the form panels used to construct the concrete structure 16 is performed by workers standing or otherwise positioned on the working deck 30. That is, the deck 30 provides easy access to the form panels 18 for preparing the panels 18 for pouring concrete and then disassembling or otherwise preparing the panels 18 for moving after the concrete has been poured. Further, a central power hub 40 is positioned on the working deck 30 and is coupled to the actuation pumps 52 coupled with the masts 14, as will be described in additional detail below. Alternatively, it is understood that the central power hub 40 need not be positioned on the working deck 30 and instead can be positioned on any deck level (including, for example, the lower deck 32 or the top deck 12).

According to the specific exemplary embodiment of FIGS. 1A-1H, there are actually two sets of working decks 30 and lower decks 32 (or deck sections 44, 46, as mentioned above) attached to the building structure 16 as shown. The need for two deck sections 44, 46 results from the elevator core that has been incorporated into the building structure 16 in this specific implementation. More specifically, the structure 16 has horizontal concrete slabs 42 that extend across the interior of the structure 16 (such that the elevators will be disposed on either side of the slabs 42 upon completion of the building). Because the slab 42 extend across the interior, the decks 30, 32 cannot extend along walls 16A or 16C. As such, the hoist 10 in this embodiment has one top deck 12 with two lower deck sections 44, 46, with the two deck sections 44, 46 disposed within the interior of the building structure 16 on opposite sides of the horizontal concrete slabs 42. As best shown in FIGS. 1B, 1C, 1D, 1G, and 1H, the first deck section 44 is disposed along the length of the wall 16B and coupled to/supported by masts 14A and 14B. In contrast, as best shown in FIGS. 1B, 1E, 1F, and 1G, the second deck section 46 is disposed along the length of the wall 16D and coupled to/supported by masts 14C and 14D.

While this exemplary embodiment has two deck sections 44, 46, it is understood that, in various implementations in which the building structure 16 has no horizontal concrete slabs (or other structures) disposed through the interior thereof, there is no need for separate deck sections. As such, in those embodiments, the hoist 10 can have one working deck and one lower deck, both of which extend around and are disposed against all four interior walls of the structure.

Figure 1C:
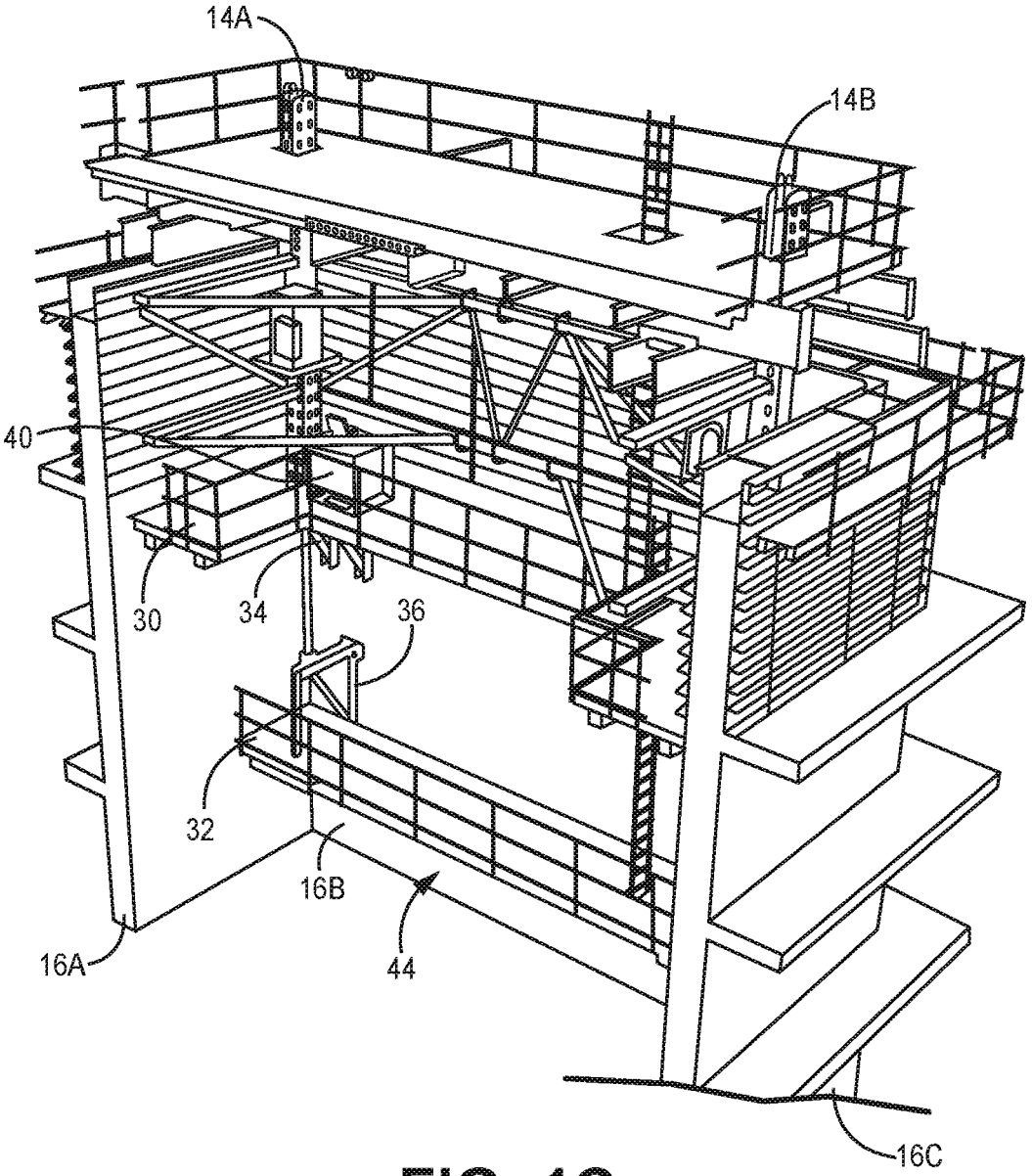
FIG. 1C depicts a cutaway upper perspective of a portion of the wall climbing hoist system of FIG. 1A, according to one embodiment.
Figure 1D:
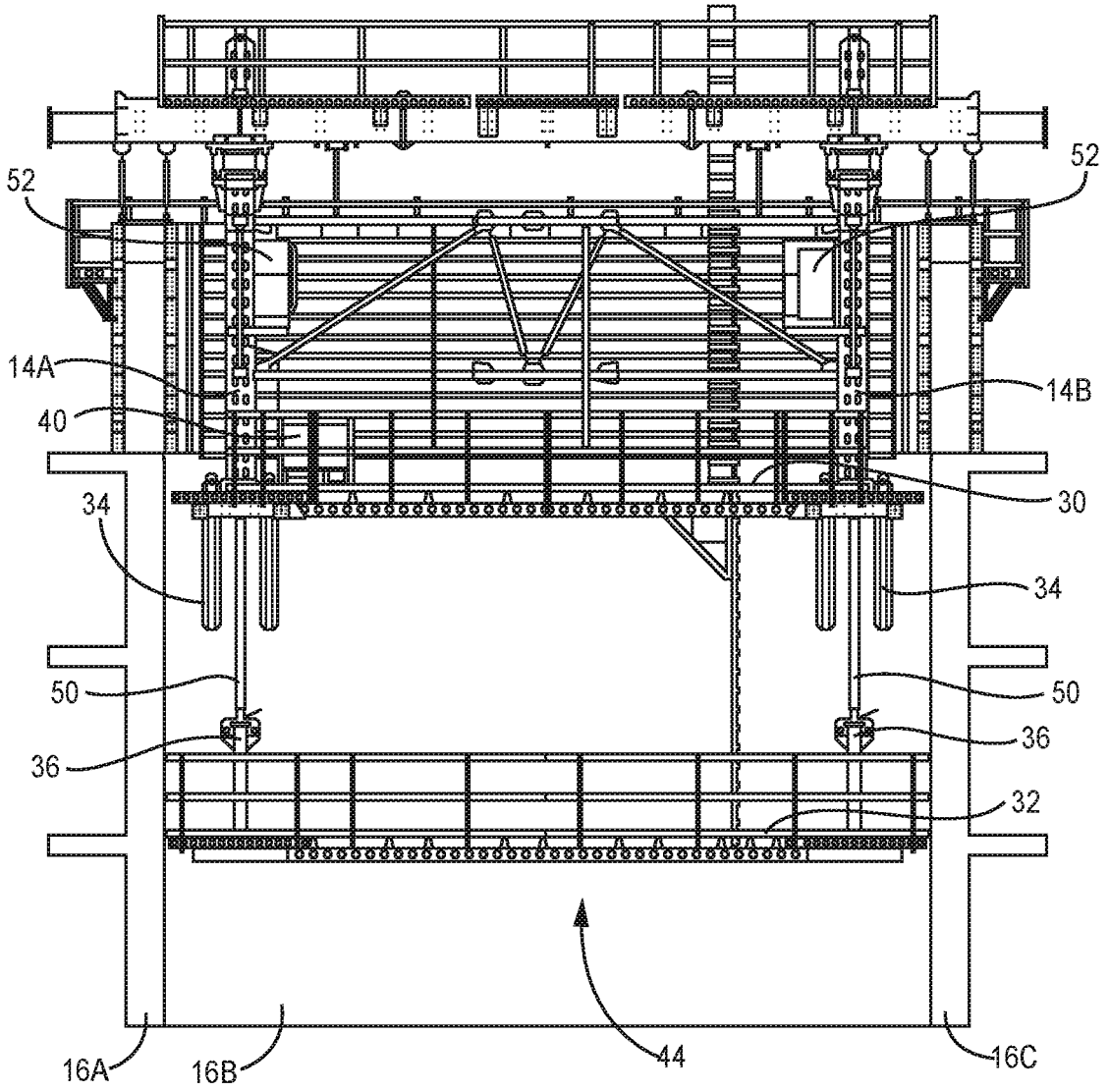
FIG. 1D depicts a cutaway side view of the portion of the wall climbing hoist system of FIG. 1B with the lift cylinders extended, according to one embodiment.
Figure 1E:
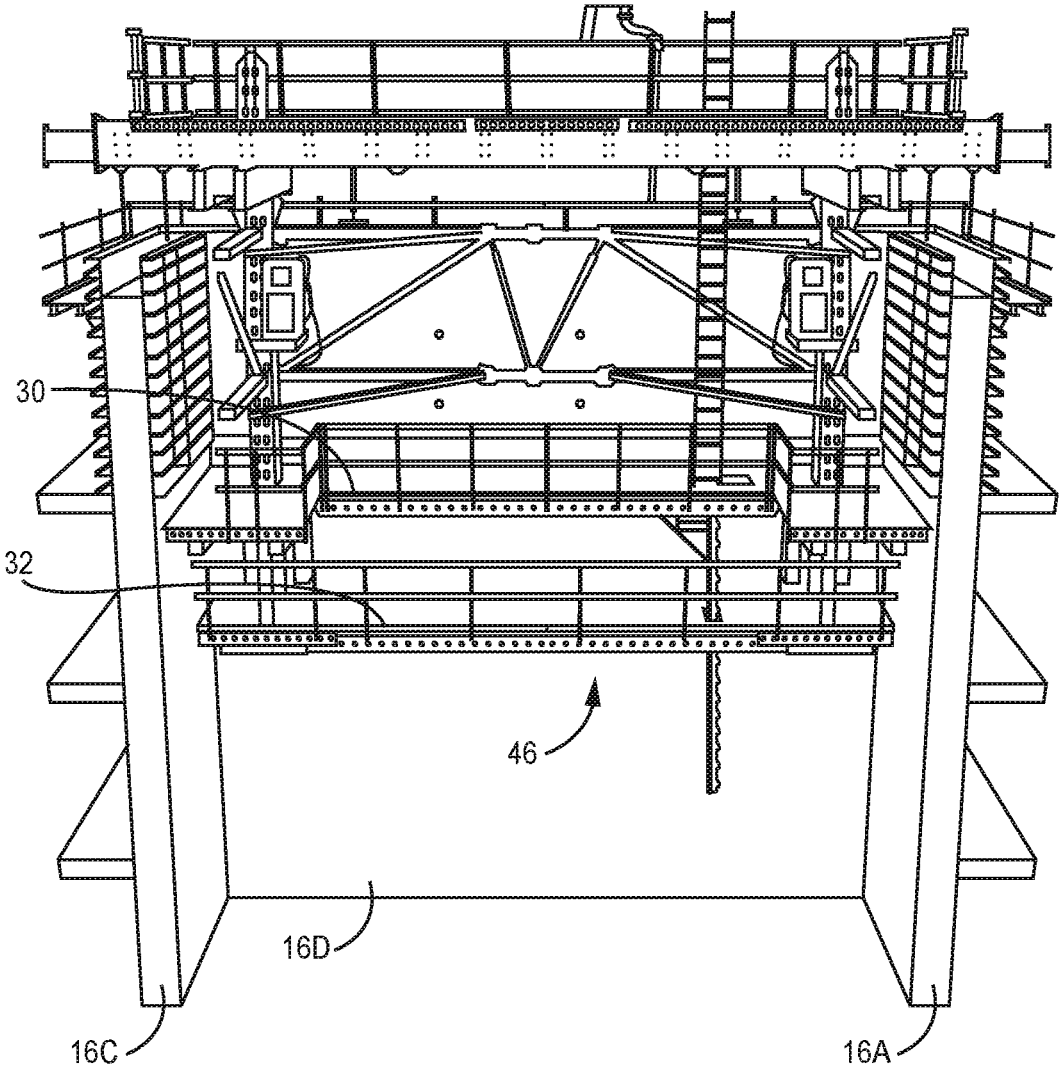
FIG. 1E depicts a cutaway upper perspective of another portion of the wall climbing hoist system of FIG. 1A on another wall of the structure with the lift cylinders retracted, according to one embodiment.
Figure 1F:
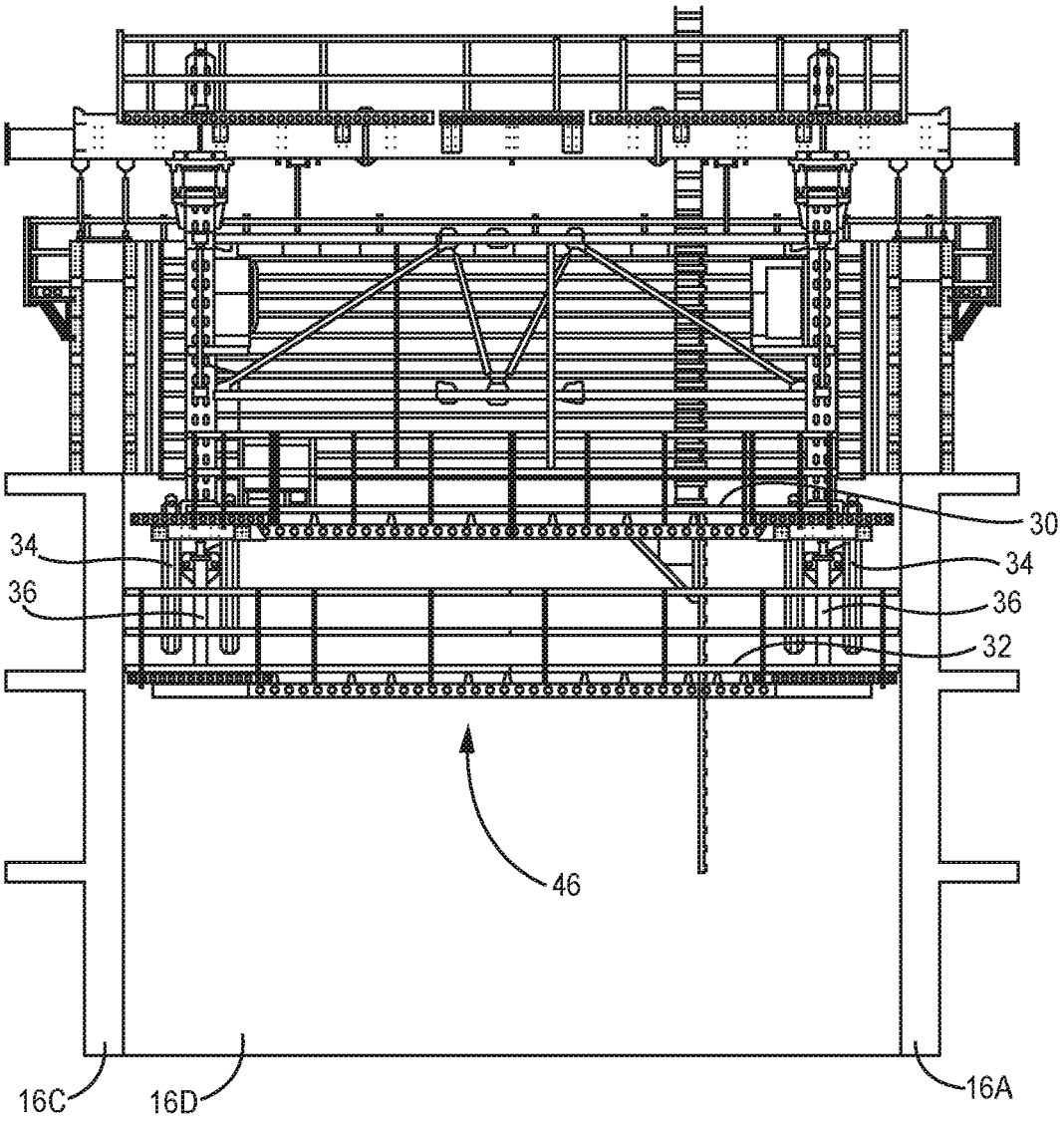
FIG. 1F depicts a cutaway side view of the portion of the wall climbing hoist system of FIG. 1E, according to one embodiment.
Figure 1G:
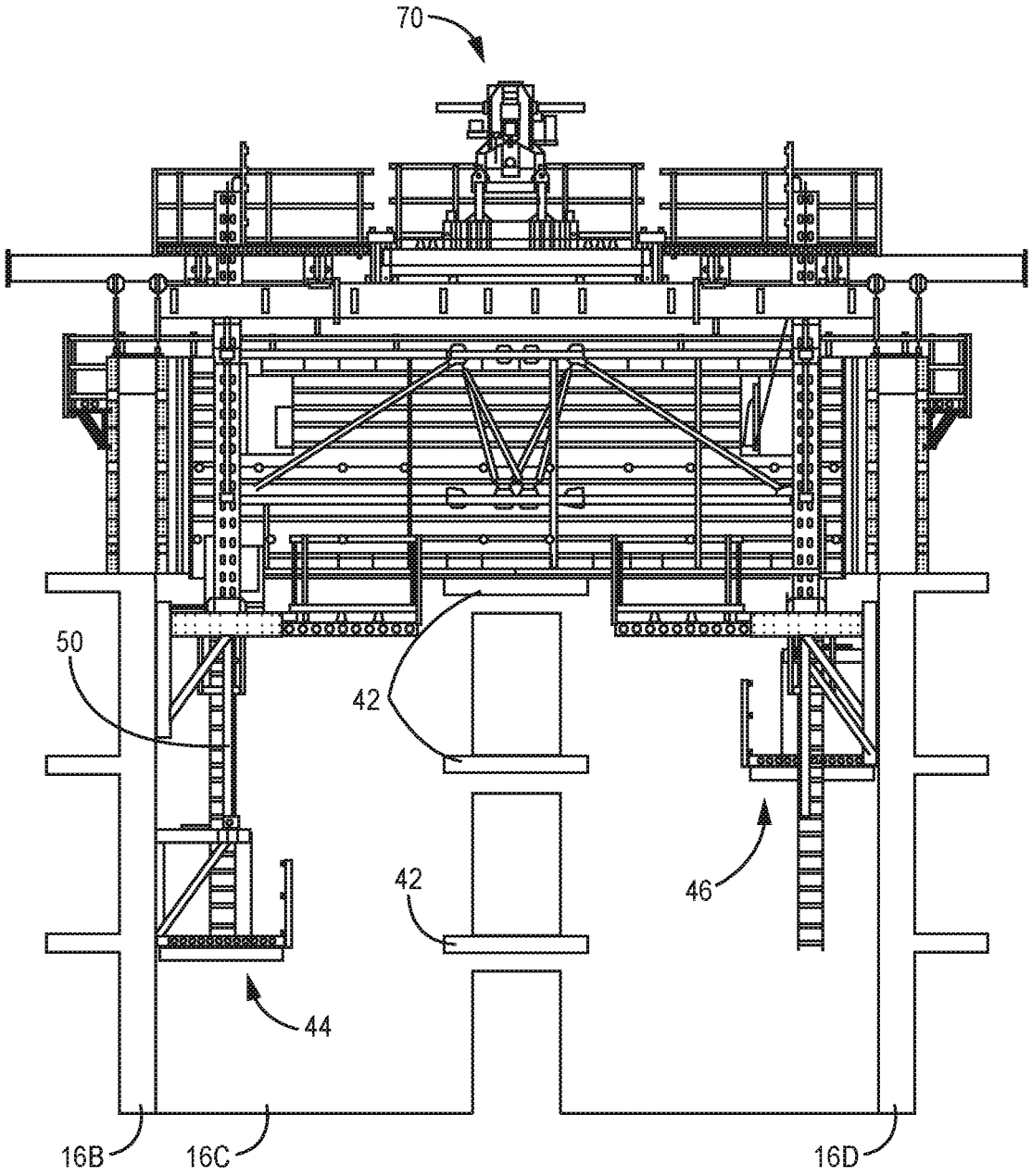
FIG. 1G depicts a different cutaway side view providing another perspective of the wall climbing hoist system of FIG. 1B which illustrates the different elevations of the lower supports during the formwork cycling process, with section 44 having the lift cylinders extended and section 46 having the lift cylinders retracted, according to one embodiment.

The hoist 10 operates by being coupled to the concrete walls of the building structure 16 that is being constructed via the working deck 30 and the lower deck 32. More specifically, the hoist 10 is supported by two different sets of brackets that are systematically and alternately attached (as will be described in additional detail below) to the interior surface of the structure 16 walls (in this specific example, walls 16B and 16D, as discussed above) of the concrete structure 16 being constructed: support brackets 34 (supporting the working deck 30) and jack (or "lift") support brackets 36 (supporting the lower deck 32), as best shown in FIGS. 1C, 1D, and 1F. As mentioned above, each of the masts 14 is coupled to and supported by a support bracket 34 such that each support bracket 34 is attached to the bottom portion of a mast 14, as best shown in FIGS. 1D, 1E, and 1G.

Figure 1H:
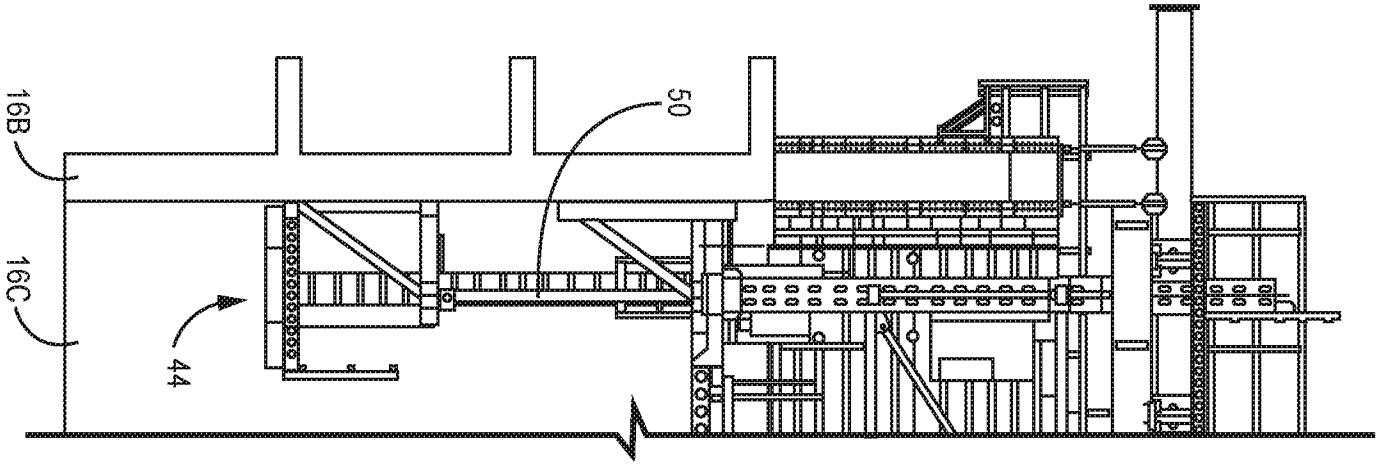
FIG. 1H is an expanded view of a portion of the wall climbing hoist system of FIG. 1G, according to one embodiment.

As mentioned above, each mast 14 has a lift cylinder 50 coupled thereto. That is, as best shown in FIGS. 1E, 1F, and 1G, each mast 14 has a lift cylinder 50 that is disposed within and moveably coupled to the mast 14 such that the cylinder 50 can move between a retracted position (within the mast 14) and an extended position in which the cylinder 50 is extended out of the bottom of the mast 14 (as best shown in FIGS. 1D, 1G, and 1H). More specifically, each cylinder according to any embodiment disclosed or contemplated herein (including, for example, cylinder 50) can move between a fully retracted position in which the cylinder is disposed entirely within the mast (such as mast 14) and an extended position in which the cylinder extends a predetermined length out of the bottom of the mast (such as mast 14), wherein the predetermined length of the extension can be any length up to the full extended length of the cylinder. According to one embodiment, the cylinder can have a length of 16 feet, such that the fully extended length of the cylinder is about 16 feet. Alternatively, the cylinder can have any known length for use in a hoist embodiment as contemplated herein, which can depend, for example, on the height of the floors of the structure being constructed.

In certain embodiments, any lift cylinder 50 herein is a hydraulic cylinder 50 that operates hydraulically. Alternatively, rather than hydraulic actuation, the lift cylinder 50 can be operate via any form of actuation.

As best shown in FIG. 1D, each mast 14 has a power unit 52 coupled to the mast 14 and the attached lift cylinder 50 to power the movement of the lift cylinder 50 between the retracted and extended positions. In certain embodiments, the power unit 52 is a hydraulic power unit 52. Alternatively, the power unit 52 can be any form of power unit 52. Providing a separate power unit 52 for each cylinder 50/mast 14 clears work space and eliminates the need for long power hoses or connections (such as, for example, hydraulic hoses) routed back to a central power location. According to one embodiment, the extendable cylinders 50 are controlled by the power unit 52 such that the cylinders 50 move continuously during a raise and are controlled to accelerate or decelerate as needed by the control system to maintain a level alignment of the hoist 10 throughout the raise. Each cylinder 50 is coupled at its bottom or lower end to a jack bracket 36. Thus, each lift cylinder 50 provides for extending the attached mast 14 upward away from the jack bracket 36 at the appropriate time to raise the hoist 10, as described in further detail below.

In accordance with certain embodiments, each lift cylinder 50 has a position sensor (not shown) disposed within the cylinder 50. The position sensor (not shown) is configured to track the position of cylinder 50 in relation to the mast 14 such that the length of any extension of the cylinder 50 from the mast 14 can be monitored. The sensor (not shown) is also operably coupled to a microcontroller in the associated power unit 52 (coupled to the mast 14 in which the cylinder 50 is disposed). According to one implementation, the sensor is a magnetostrictive, absolute, non-contact linear position sensor. Alternatively, the sensor can be any known position sensor that can operate as described herein.

Figure 2A:
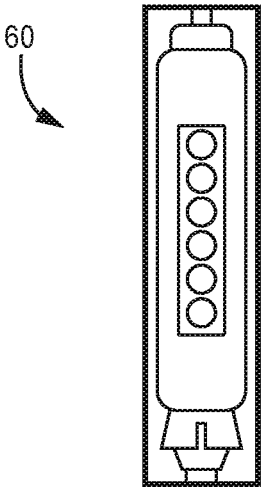
FIG. 2A depicts a controller, according to one embodiment.
Figure 2B:
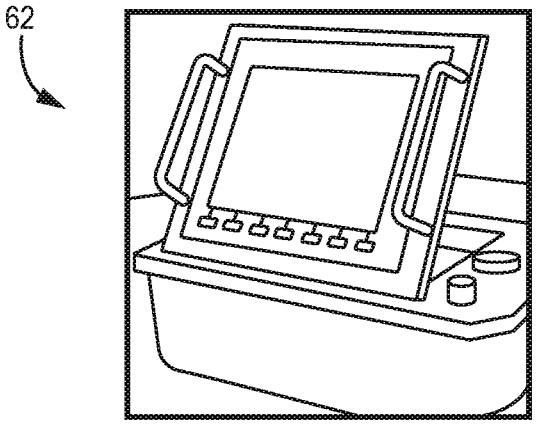
FIG. 2B depicts another controller, according to another embodiment.

Control of the power units 52 can be provided via any one of at least four different devices or methods. That is, according to various different embodiments, a user can control the units 52 via any of the following different controllers. One controller is a handheld controller (also referred to herein as a "pendant") 60, as best shown in FIG. 2A. In one embodiment, the controller 60 is a global pendant 60 that is coupled to all of the power units 52 such that the controller 60 can be used to operate the entire hoist 10. In accordance with one specific implementation, the global pendant 60 is coupled to the power units 52 through a port in the central power hub 40. It is understood that any central controller as described or contemplated herein can be coupled to the power units 52 via the central power hub 40. Further, it is understood that because the various power units 52 can each be coupled to the central power hub 40 for controlling and/or providing power to the power units 52, the hub 40 can be configured to be coupleable with the locally available power supply of any voltage for operation of any number of power units 52 of the hoist 10. In another implementation, the hoist 10 can have a separate controller 60 for each of the power units 52 such that, in this embodiment, there are four separate controllers 60, with each such controller 60 controlling one of the four power units 52. According to a further embodiment, as best shown in FIG. 2B, the controller 62 can be a portable central control console 62, which is essentially a computer-based console controller 62 with a screen and an interface. In one embodiment, the console controller 62 can be any known console for use with concrete pouring hoist systems of any kind. According to a further implementation, the controller can be a wireless go-anywhere remote (not shown). Alternatively, an application for a smartphone, pad, or other mobile device can be used to control the power units 52. In yet another alternative, any known interface or device for controlling such a system can be used. In accordance with certain embodiments, any single central controller (such as, for example, a global pendant 60 or a console controller 62) can control any number of power units 52 that make up the entire hoist 10.

In one embodiment, the controller 62 is operably coupled to the power units 52 (in some implementations via the central power hub 40) and thus to the microprocessors therein that are in communication with the position sensors described above. Alternatively, the controller 62 is operably coupled directly to the position sensors. Regardless, either the controller 62 in conjunction with the power units 52 and the sensors (not shown) or the power units 52 in conjunction with the sensors (not shown) can utilize information from the sensors (not shown) to speed up or slow down the relevant cylinders 50 and thereby maintain a level lift. It is understood that the central power hub 40 can also play a role in this process. In accordance with certain implementations, the combination of components herein can allow for more than just the function of maintaining the hoist 10 in a level disposition. That is, the controller 62 in conjunction with the power units 52 can also provide auto-levelling, increasing or decreasing the speed of the entire system, providing the same functionality in retract mode as extend mode, and allowing for multiple control options, and other such functionality. Thus, according to certain embodiments, the controller 62 and/or the central power hub 40 can function to not only control, but also synchronize, the operation of the two or more power units 52 to ensure that the hoist 10 has a level disposition while stationary and while being raised.

The hoist 10, in various embodiments, can have an automatic safety stop incorporated into the system. More specifically, the controller 62 is operably coupled to various sensors on the hoist 10 that can track individual loads, oil temperature, low oil reservoir, system pressure, damaging low voltage, and any other known parameters that can be sensed or tracked by sensors or other similar components. In such implementations, the controller 62 can be configured to trigger an automatic stop of the entire hoist 10 if any of the tracked parameters (such as those listed above) exceed or drop below a predetermined threshold. This automatic safety stop can reduce the risk of catastrophic failure and potential injury to workers on or around the hoist 10.

Returning to FIG. 1A, the support frame 12 also supports a known concrete boom unit 70 that is disposed on the support frame 12 and has a concrete pumping line 72. The line 72 runs from the concrete source (not shown) positioned on the ground, up through the concrete structure 16, through the support frame 12 at the boom unit 70, and then along the boom 74 as shown in FIG. 1A. The boom unit 70 and pumping line 72 allow for transporting fresh concrete from the ground and pouring the fresh concrete between the form panels 18A, 18B. Alternatively, any known concrete pumping system can be used with the hoist 10.

Figure 3:
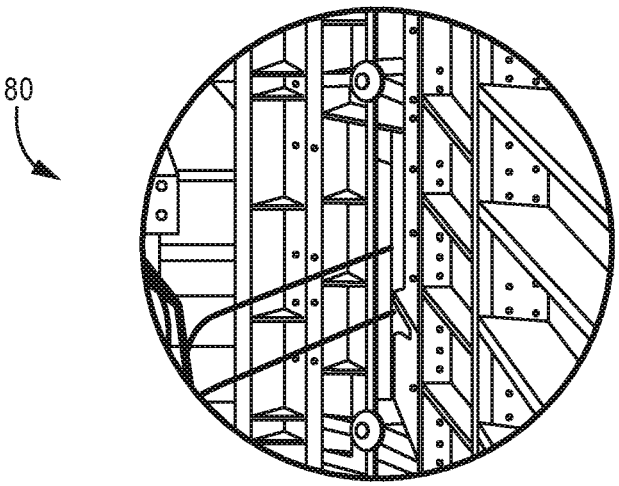
FIG. 3 depicts an expanded view of a hydraulically operated stripping corner, according to one embodiment.

In accordance with certain alternative embodiments as best shown in FIG. 3, the hoist 10 can have a hydraulically operated stripping corner 80 (which is the subject of U.S. Patent Application 62/685,414, entitled "Self-Stripping Corner Form" and filed on Jun. 15, 2018, which is incorporated herein by reference in its entirety) for easing the pouring of wall corners and stripping the formwork when the concrete is set. Alternatively, any hoist 10 embodiment herein does not require the stripping corner 80.

In the specific exemplary embodiment herein as best shown in FIG. 1A, the hoist 10 has four masts 14A, 14B, 14C, 14D. It is understood that the number of masts 14 is generally determined based on the size of the footprint of the building structure (like structure 16) being constructed. For example, the size of the hoist 10 used for a small structure with a small footprint (about the size of an elevator shaft, for example) may only require a single mast. Alternatively, larger structures having larger footprints may require 6, 8, 10, 12 or any number of masts as necessary to ensure sufficient support for the hoist 10 and the decks herein. Thus, the hoist 10 can have any number of masts 14 depending on the size of the structure 16 being constructed.

Figure 4A:
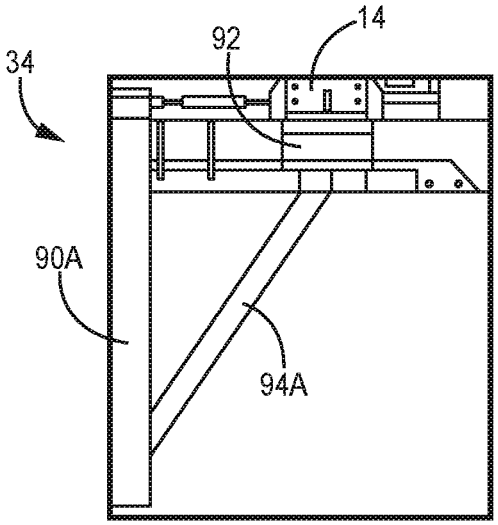
FIG. 4A is a side view of a support bracket, according to one embodiment.
Figure 4B:
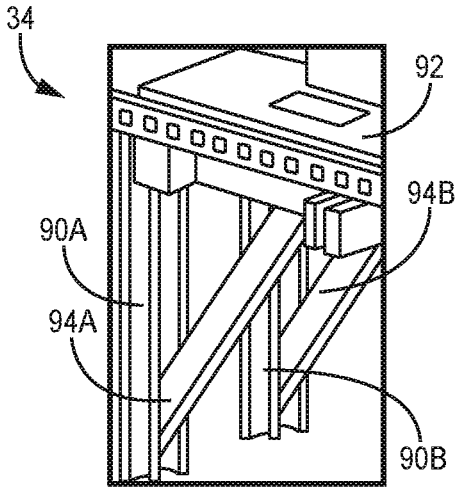
FIG. 4B is a perspective view of the support bracket of FIG. 4A, according to one embodiment.

FIGS. 4A and 4B depict one exemplary support bracket 34 in additional detail, according to one embodiment. As shown, in accordance with one implementation, the bracket 34 has two vertical bars (or "beams") 90A, 90B that can be disposed against the wall of the structure 16 to which the support bracket 34 is attached, a horizontal beam (also referred to as a "bar" or "base") 92 coupled to the two bars 90A, 90B, and two angled struts (or "beams") 94A, 94B that extend from the vertical bars 90A, 90B to the horizontal beam 92 to provide support to the beam 92. As best shown in FIG. 4A, the horizontal beam 92 has a bottom end of a mast 14 coupled thereto. It is understood that there is at least one attachment feature or device (not shown) on each of the vertical bars 90A, 90B that allow for attaching the bars 90A, 90B to the wall as desired (and as described in additional detail below). For example, in one embodiment, the attachment feature is at least one opening (not shown) defined within each vertical bar 90A, 90B that is configured to receive an anchor, through-bolt, or other such attachment device or mechanism that can be positioned through the opening and into the concrete wall for attachment thereto. Alternatively, the attachment device or mechanism can be any such known device or mechanism. Alternatively, the support brackets 34 can be any known support structures having any known configuration for use in temporarily attaching a hoist (such as hoist 10), and more specifically a deck such as a working deck 30, to a concrete wall.

As will be discussed in further detail below, the support brackets 34 are secured to the concrete structure 16 to support the hoist 10 (and more specifically, the working deck 30) when it is not being used to cycle the equipment to the next lift. That is, when the hoist 10 has been positioned as desired such that the working deck 30 is disposed adjacent to the form panels 18 and the panels 18 are at the appropriate height for pouring the concrete for the next section of the walls, the support brackets 34 are attached to the walls, thereby stabilizing and supporting the working deck 30.

Figure 5A:
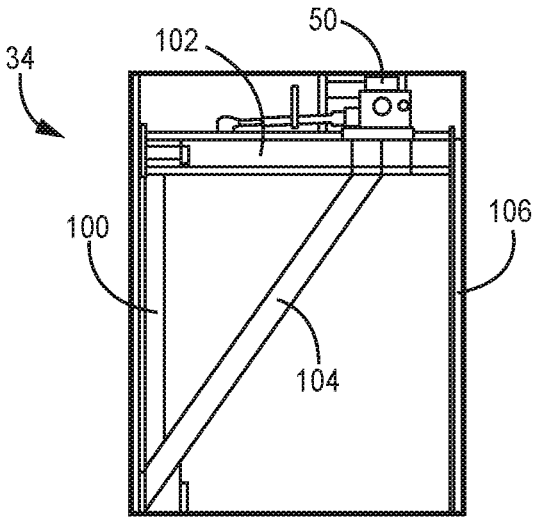
FIG. 5A is a side view of a jack bracket, according to one embodiment.
Figure 5B:
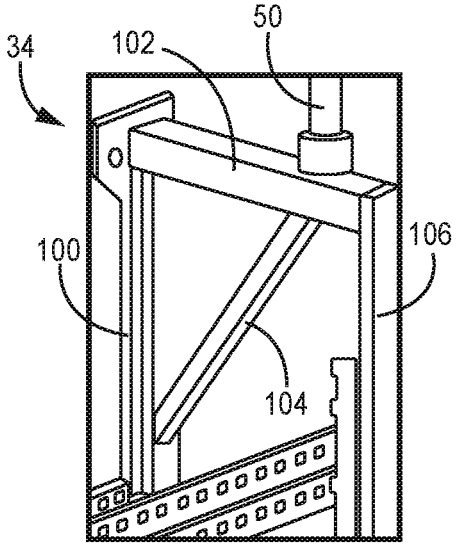
FIG. 5B is a perspective view of the jack bracket of FIG. 4A, according to one embodiment.

FIGS. 5A and 5B depict one exemplary jack bracket 36 in additional detail, according to one embodiment. As shown, in accordance with one implementation, the bracket 36 has a vertical bar (or "beam") 100 that is capable of being disposed against the wall of the structure 16 to which the hoist 10 is attached, a horizontal bar 102 coupled at one end to the top of the vertical bar 100, and an angled strut (or "crossbar") 104 that extends from the lower portion of the vertical bar 100 to the horizontal bar 102 as shown to provide support to the horizontal bar 102. In addition, the bracket 36 also has a vertical deck support bar (or "beam") 106 that is coupled to the end of the horizontal bar 102 opposite the vertical bar 100 and is configured to be attached to and support the lower deck 32. More specifically, the bar 106 is coupled at its top end to the horizontal bar 102 and is coupled at its bottom end to the lower deck 32, thereby providing support to the lower deck 32. The horizontal beam 102 has a bottom end of an extendable cylinder 50 coupled thereto, as shown. It is understood that there is at least one attachment feature or device (not shown) on the vertical bar 100 that allows for attaching the bar 100 to the wall as desired (and as described in additional detail below). For example, in one embodiment, the attachment feature is at least one opening (not shown) defined within the vertical bar 100 that is configured to receive an anchor, through-bolt, or other such attachment device or mechanism that can be positioned through the opening and into the concrete wall for attachment thereto. Alternatively, the attachment device or mechanism can be any such known device or mechanism. Alternatively, the jack brackets 36 can be any known support structures having any known configuration for use in temporarily attaching a hoist (such as hoist 10), and more specifically a deck such as a lower deck 32, to a concrete wall and further for supporting an extendable cylinder 50 as described herein.

In the implementation as depicted in FIGS. 1A-1H, the hoist 10 is being used to help pour the concrete walls of a building structure 16 having four walls 16A, 16B, 16C, 16D. Alternatively, various hoist embodiments can be used to build a structure (or a portion thereof) having one wall, two walls, three walls, or five or more walls.

In use, the hoist 10 is used to construct a concrete building structure (like structure 16, for example) in the following manner. As an initial matter, prior to attachment of the hoist 10 to the structure 16, the first story of the concrete walls 16A, 16B, 16C, 16D is poured in any known conventional fashion. The first story of the structure 16 is poured first so that the walls 16A, 16B, 16C, 16D can receive the hoist 10 (that is, so that the hoist 10 can be attached thereto). (As an aside, it should be noted at this point that in FIGS. 1A-1H, four stories of the walls 16A, 16B, 16C, 16D have already been poured.) Once the concrete for the first story has set, the hoist 10 is attached to the structure 16. More specifically, a crane or any other known independent hoist means is used to lift the wall climbing form hoist 10 into position adjacent the concrete walls (like the first story of walls 16A, 16B, 16C, 16D). In this specific implementation, the positioning of the hoist 10 includes positioning the first deck section 44 along the wall 16B and positioning the second deck section 46 along the wall 16D and attaching the sections 44, 46 by releasably attaching the support brackets 36 of each to the respective walls as discussed below. Alternatively, as discussed above, in those building structure 16 without any horizontal structures disposed within the interior of the structure 16, the hoist 10 can have one single first deck section 44 and one single second deck section 46, both of which extend around the entire interior of the structure 16.

At this point, the support brackets 34 are releasably attached to the structure 16, thereby attaching the hoist 10 to the walls. That is, the support brackets 34 of the working deck 30 of the first deck section 44 are attached to the wall 16B, and the support brackets 34 of the working deck 30 of the second deck section 46 are attached to the wall 16D. At the same time, the top deck 12 is secured to the four masts 14. Once the brackets 34 have been secured to the walls and the top deck 12 has been secured to the masts 14 such that the hoist 10 is attached as desired (that is, such that the working deck 30 is supported by the brackets 34 so that workers can move around on the deck 30), all appropriate formwork and accessories are then attached to the hoist 10 so as to form the desired profile for the next story. Concrete can then be poured in the forms which are left in place until the concrete cures.

Returning to FIGS. 1A-1H, the operation of the wall climbing form hoist 10 will be more fully understood by reference to a description of a full cycle of the hoist 10 in pouring a story of a concrete wall for the structure 16. As shown in FIGS. 1A-1H (and as mentioned above), four stories of the concrete walls 16A, 16B, 16C, 16D have been poured. The hoist 10 of FIGS. 1A-1H is positioned as shown because fresh concrete has recently been poured between the forms 18A, 18B for the fourth story. More specifically, the working decks 30 of sections 44 and 46 are attached via the support brackets 34 to the walls 16B, 16D because the workers were working on those decks 30 to set up the forms 18A, 18B and pour the concrete. The hoist 10 is maintained in this position as shown with the forms 18A, 18B disposed as shown until the fresh poured concrete has been deemed to be sufficiently mature such that the hoist 10 can be moved. Once the concrete has set, the hoist 10 is prepared to move into position to raise the hoist 10 in order to begin preparations to pour the concrete for the fifth floor of the concrete walls 16A, 16B, 16C, 16D. According to one embodiment, at this point (when the concrete is set and the hoist 10 is being prepared to be raised), the lower decks 32 of both sections 44, 46 are in the raised position, as best Illustrated in FIGS. 1E and 1F, and the jack brackets 36 are securely attached to walls 16B and 16D. That is, the standard implementation provides for the decks 30, 32 of the two sections 44, 46 moving in a substantially synchronized fashion, such that the lower desks 32 of both sections 44, 46 are raised at the same time and the upper decks 30 of both sections 44, 46 are raised at the same time as well.

Alternatively, as best shown in the alternative embodiment depicted in FIGS. 1B, 1E, 1F, and 1G, the decks 30, 32 of the two different sections can be moved at different times. For example, in FIGS. 1B, 1E, 1F, and 1G, the section 46 lower deck 32 has already been detached from the wall and raised to the next level as shown. That is, the lower deck 32 has been raised to the third story as shown in the figures. In contrast, in this alternative implementation, the section 44 lower deck 32 is still at the lower position, as best shown in FIGS. 1C, 1D, and 1G.

Returning to the standard embodiment (in which the decks 30, 32 of the two sections 44, 46 move together and the lower decks 32 of both sections 44, 46 are in the raised position as shown in FIGS. 1E and 1F), at this point, the concrete has been poured and has cured. As a result of the concrete being cured, the forms 18A, 18B will be released from the newly poured wall sections by removing all ties, yokes and any other items that would keep the hoist assembly 10 from stripping away from the concrete structure 16 (and then, if being used, the hydraulic stripping corners 80 (as shown in FIG. 3) are stripped as well). Once the forms are fully separated from the walls 16A, 16B, 16C, 16D, the hoist 10 will be prepared to be raised such that the top deck 12 and the working deck 30 are raised to the appropriate level to pour the next floor of concrete.

Once the forms have been separated from the walls 16A, 16B, 16C, 16D and the hoist 10 prepared, the support brackets 34 are detached from the walls 16B, 16D, thereby detaching the working decks 30 of the two sections 44, 46 from the walls 16B, 16D as well. In one embodiment, to the extent that any shear of the bolts (or other attachment devices) of the support brackets 34 has made removal/detachment difficult, the lift cylinders 50 can be extended slightly to shift the working deck 30 upward slightly, thereby alleviating any such shear and making detachment of the support brackets 34 easier. Once the support brackets 34 and thus the working decks 30 have been successfully detached from the walls 16B, 16D, the extendable cylinders 50 of both sections 44, 46 are extended, causing the top deck 12 and the working decks 30 to move upward. When the top deck 12 and the working decks 30 reach the desired height (such that the working decks 30 are disposed at a height that allows the workers to prepare the form panels 18 for the next pour), the support brackets 34 are once again attached to the walls 16B, 16D, thereby attaching the working decks 30 to the walls 16B, 16D. At this point, the formwork and any required ties, yokes, anchors and bolts can be installed in preparation for pouring the next section of concrete. Thus, as in every embodiment disclosed or contemplated herein, extension of the cylinders 50 raises the masts 14, the upper deck(s) 30, and the top deck 12, while the lower deck (or decks) 32 is attached to the walls 16B, 16D and thus remains stationary during the raising of the upper deck(s) 30 and the top deck 12.

Once the support brackets 34 are firmly secured to concrete walls 16B and 16D, the lower deck 32 can then be raised, as shown in FIGS. 1B, 1E, 1F, and 1G. The raising of the lower deck 32 of the sections 44, 46 is accomplished in the following manner. The jack brackets 36 are detached from the walls 16B, 16D while the support brackets 34 remained attached (thereby maintaining attachment of the hoist 10 to the structure 16). Once the jack brackets 36 are detached, the extendable cylinders 50 of the masts 14 are retracted into the masts, thereby pulling the lower decks 32 of sections 44, 46 upward until such point where the lower deck 32 is disposed at the desired, raised height as shown in FIGS. 1E and 1F. Once the lower deck 32 of section 44 and 46 is positioned as desired, the jack brackets 36 are then attached to the walls 16B, 16D. Thus, as in every embodiment disclosed or contemplated herein, retraction of the cylinders 50 raises the lower deck (or decks) 32 while the upper deck (or decks) 30 is attached to the wall 16D such that the masts 14 and the top deck 12 are stationary during the raising of the lower deck(s).

According to any of the implementations disclosed or contemplated herein, the retraction and extension of the cylinders 50 as described herein can occur without the cylinders 50 stopping during the retraction or extension thereof. In other words, the cylinders 50 in certain embodiments accelerate or decelerate, rather than coming to a full stop, during the retraction or extension of the cylinders. By eliminating the stopping and restarting of the cylinders 50 during the retraction or extension thereof, the raising of the lower deck 32 or the upper deck 30 and top deck 12 occurs more smoothly than is possible if the cylinders 50 were coming to full stops at any point during the retraction or extension thereof. The smooth movement of the hoist 10 results in a smoother ride for the operator and any other workers on the hoist 10.

This cycle is repeated for each new floor of the structure 16 until the desired number of floors of the structure have been poured. Once the full height of the walls is poured, the wall climbing form hoist 10 is typically removed from the building structure 16 by a crane or similar device or procedure. Alternatively, the form hoist 10 can be lowered down the structure 16 in a set of cycles that are generally simply a reverse of the steps used to climb up the structure 16. That is, according to one embodiment of the climbing form hoist 10, the movement of the form hoist 10 to a downward position may be effectuated under its own power rather than being removed from the structure 16 by a crane.

In accordance with certain embodiments, the cycling of the concrete wall attachment between the support brackets (such as brackets 34) and the jack brackets (such as brackets 36) allows for the various hoist embodiments (such as hoist 10) disclosed or contemplated herein to operate without any delays or waiting periods to allow the concrete to cure. More specifically, the jack brackets (such as brackets 36) remain attached to the cured concrete that was placed prior to the freshly poured (and thus not yet cured) concrete, thereby making it possible to continue use of the hoist 10 and work thereon without any downtime to allow for the concrete to cure. Generally, the cured concrete poured before the new concrete has matured for several days and thus is capable of supporting the loads that can be generated by the hoist embodiments disclosed or contemplated herein (such as hoist 10). Thus, once the forms are stripped after a pour, the hoist 10 can immediately be raised to the next story, substantially reducing the time to cycle the system after the fresh concrete has been poured in comparison to known systems that require such a delay. The time savings due to not having to wait for the concrete to cure after a pour has a significant impact on a project's completion schedule and the resulting associated cost.

Although the present invention has been described with reference to preferred embodiments, persons skilled in the art will recognize that changes may be made in form and detail without departing from the spirit and scope of the invention.

What is claimed is:

1. A self-climbing concrete wall form hoist for forming a concrete wall section atop a previously formed wall section, the hoist comprising:

(a) upper and lower wall mountings releasably secureable to the previously formed wall section;

(b) at least one moveable vertical mast;

(c) an extendable cylinder moveably coupled with the at least one mast, the cylinder being moveable between:

(i) a retracted position wherein the cylinder is disposed within the at least one mast; and (ii) an extended position wherein the cylinder is extended from the at least one mast;

(d) a platform attached to the at least one moveable vertical mast;

(e) at least one power unit coupled to the at least one moveable vertical mast, wherein the at least one power unit is operably coupled to the extendable cylinder, wherein the at least one power unit urges the extendable cylinder between the retracted and extended positions;

(f) a control system operably coupled to the at least one power unit, wherein the control system is configured to control operation of the at least one power unit; and (g) a controller unit in communication with the control system, wherein the form hoist is cycleable between:

(i) a platform raising configuration wherein the extendable cylinder is supported on the lower wall mounting, wherein the extendable cylinder is extendable into the extended position, whereby the platform is raised in relation to the concrete wall section; and (ii) a lower wall mounting raising configuration wherein the platform is supported on the upper wall mounting, wherein the extendable cylinder is retractable into the retracted position, whereby the lower wall mounting is raised in relation to the platform.

2. The self-climbing concrete wall form hoist of claim 1, wherein the at least one moveable vertical mast comprises at least two moveable vertical masts; and the extendable cylinder moveably coupled with the at least one moveable vertical mast comprises at least two extendable cylinders, wherein a first of the at least two extendable cylinders is coupled to a first of the at least two vertical masts and a second of the at least two extendable cylinders is coupled to a second of the at least two vertical masts.

3. The self-climbing concrete wall form hoist of claim 2, wherein the at least one power unit comprises:

(a) a first power unit coupled to a first of the at least two moveable vertical masts, wherein the first power unit is operably coupled to the first of the at least two extendable cylinders, wherein the first power unit urges the first extendable cylinder between the retracted and extended positions; and (b) a second power unit coupled to a second of the at least two moveable vertical masts, wherein the second power unit is operably coupled to the second of the at least two extendable cylinders, wherein the second power unit urges the second extendable cylinder between the retracted and extended positions.

4. The self-climbing concrete wall form hoist of claim 3, wherein the control system is operably coupled to at least the first and second power units, wherein the control system is configured to control operation of at least the first and second power units such that the control system causes at least the first and second power units to accelerate or decelerate to maintain a level alignment of the hoist platform throughout movement between the extended and retracted positions of the at least two extendable cylinders.

5. The self-climbing concrete wall form hoist of claim 4, wherein each of the at least two extendable cylinders comprises a position sensor, wherein the control system is operably coupled to the position sensor such that the control system is configured to determine the necessary power for cylinder extension or retraction, wherein the control system is configured to control the at least two power units based on the necessary power.

6. The self-climbing concrete wall form hoist of claim 4, wherein the control system is configured to synchronize operation of at least the first and second power units.

7. A self-climbing concrete wall form hoist comprising:

(a) at least two extendable masts, each of the at least two masts comprising:

(i) a mast body comprising an interior cavity; and (ii) an extendable cylinder moveably coupled to the mast body, wherein each of the at least two masts is adjustable between:

(i) a retracted position wherein the extendable cylinder is disposed within the interior cavity; and (ii) an extended position wherein the extendable cylinder is extended a predetermined length out of the mast body;

(b) a lower removable attachment mechanism releasably attachable to a previously formed concrete wall section, wherein the lower removable attachment mechanism is fixedly coupled to the extendable cylinder;

(c) an upper removable attachment mechanism releasably attachable to the previously formed concrete wall section, wherein the upper removable attachment mechanism is fixedly coupled to the mast body;

(d) a platform attached to the at least one extendable mast, wherein the platform is disposed above the lower and upper removable attachment mechanisms;

(e) a controller operably coupled to the at least two extendable masts, wherein the controller is configured to synchronize and control operation of the at least two extendable masts such that the controller causes the extendable cylinder of each of the at least two extendable masts to accelerate or decelerate to maintain a level alignment of the platform throughout movement between the extended and retracted positions, wherein the form hoist is cycleable between:

(i) a platform raising configuration, wherein the lower removable attachment mechanism is attached to the previously formed concrete wall section, wherein the at least one extendable mast is extendable into the extended position such that the platform is raised in relation to the concrete wall section;

(ii) a lower removable attachment mechanism raising configuration, wherein the upper removable attachment mechanism is attached to the previously formed concrete wall section, wherein the extendable cylinder is retractable into the retracted position such that the lower removable attachment mechanism is raised in relation to the platform.

8. The self-climbing concrete wall form hoist of claim 7, wherein the extendable cylinder comprises a position sensor, wherein the position sensor is operably coupled to the controller.

9. The self-climbing concrete wall form hoist of claim 7, wherein the extendable cylinder is a hydraulic cylinder.

10. The self-climbing concrete wall form hoist of claim 9, wherein each of the at least two extendable masts comprises a hydraulic power unit operably coupled to the hydraulic cylinder, wherein the hydraulic power unit urges the hydraulic cylinder between the retracted and extended positions.

11. The self-climbing concrete wall form hoist of claim 10, further comprising a central power hub operably coupled to the hydraulic power unit of each of the at least two extendable masts.

12. The self-climbing concrete wall form hoist of claim 7, wherein the controller causes the extendable cylinder of each of the at least two extendable masts to accelerate or decelerate without stopping to maintain the level alignment of the platform throughout movement between the extended and retracted positions.

13. A method of building a multi-story concrete structure, the method comprising:

positioning a hoist system on a previously formed first concrete wall section, the hoist system comprising:

(a) a first extendable mast comprising a first mast body and a first extendable cylinder moveably coupled to the first mast body;

(b) a second extendable mast comprising a second mast body and a second extendable cylinder moveably coupled to the second mast body;

(c) a platform attached to the first and second extendable masts;

(d) a first lower removable attachment mechanism fixedly coupled to the first extendable cylinder;

(e a second lower removable attachment mechanism fixedly coupled to the second extendable cylinder;

(f) a first upper removable attachment mechanism fixedly coupled to the first mast body; and (g) a second upper removable attachment mechanism fixedly coupled to the second mast body;

attaching the first and second upper removable attachment mechanisms to the first concrete wall section:

forming a desired profile with formwork and pouring concrete into the formwork to add a second concrete wall section;

attaching the first and second lower removable attachment mechanisms to the first concrete wall section;

detaching the first and second upper removable attachment mechanisms from the first concrete wall section;

extending the first and second extendable cylinders such that the first and second extendable masts and the first and second upper removable attachment mechanisms are extended upward a predetermined distance;

actuating the first and second extendable cylinders with a controller to accelerate or decelerate to maintain a level alignment of the platform;

attaching the first and second upper removable attachment mechanisms to the second concrete wall section;

forming the desired profile with the formwork and pouring concrete into the formwork to add a third concrete wall section;

detaching the first and second lower removable attachment mechanisms from the first concrete wall section;

retracting the first and second extendable cylinders such that the first and second lower removable attachment mechanisms are raised upward until the first and second extendable cylinders are fully retracted; and attaching the first and second lower removable attachment mechanisms to the second concrete wall section.

14. The method of claim 13, wherein the extending the first and second extendable cylinders comprises accelerating or decelerating the first and second extendable cylinders without stopping the first and second extendable cylinders; and the retracting the first and second extendable cylinders comprises accelerating or decelerating the first and second extendable cylinders without stopping the first and second extendable cylinders.

15. A method of building a multi-story concrete structure, the method comprising:

positioning a hoist system on a previously formed first concrete wall section, the hoist system comprising:

(a) a first extendable mast comprising a first mast body and a first extendable cylinder moveably coupled to the first mast body;

(b) a second extendable mast comprising a second mast body and a second extendable cylinder moveably coupled to the second mast body;

(c) a platform attached to the first and second extendable masts;

(d) a first lower removable attachment mechanism fixedly coupled to the first extendable cylinder;

(e a second lower removable attachment mechanism fixedly coupled to the second extendable cylinder;

(f) a first upper removable attachment mechanism fixedly coupled to the first mast body; and (g) a second upper removable attachment mechanism fixedly coupled to the second mast body;

attaching the first and second upper removable attachment mechanisms to the first concrete wall section:

forming a desired profile with formwork and pouring concrete into the formwork to add a second concrete wall section;

attaching the first and second lower removable attachment mechanisms to the first concrete wall section;

detaching the first and second upper removable attachment mechanisms from the first concrete wall section;

extending the first and second extendable cylinders such that the first and second extendable masts and the first and second upper removable attachment mechanisms are extended upward a predetermined distance;

monitoring with position sensors the extension length of the first and second extendable cylinders to maintain a level alignment of the platform;

attaching the first and second upper removable attachment mechanisms to the second concrete wall section;

forming the desired profile with the formwork and pouring concrete into the formwork to add a third concrete wall section;

detaching the first and second lower removable attachment mechanisms from the first concrete wall section;

retracting the first and second extendable cylinders such that the first and second lower removable attachment mechanisms are raised upward until the first and second extendable cylinders are fully retracted; and attaching the first and second lower removable attachment mechanisms to the second concrete wall section.

16. The method of claim 15, wherein the extending the first and second extendable cylinders comprises accelerating or decelerating the first and second extendable cylinders without stopping the first and second extendable cylinders; and the retracting the first and second extendable cylinders comprises accelerating or decelerating the first and second extendable cylinders without stopping the first and second extendable cylinders.

* * * * *